United States Patent [19]

Minowa et al.

[11] Patent Number: 5,013,411

[45] Date of Patent: May 7, 1991

[54] METHOD FOR PRODUCING A CORROSION RESISTANT RARE EARTH-CONTAINING MAGNET

[75] Inventors: Takehisa Minowa; Masao Yoshikawa, both of Fukui, Japan

[73] Assignee: Shin-Etsu Chemical Co., Ltd., Tokyo, Japan

[21] Appl. No.: 359,382

[22] Filed: May 31, 1989

[30] Foreign Application Priority Data

Jun. 2, 1988 [JP] Japan ..... 63-134423

[51] Int. Cl.[5] ..... C25D 5/34

[52] U.S. Cl. ..... 204/29; 148/102; 148/103; 204/32.1; 204/42

[58] Field of Search ..... 204/29, 32.1, 42; 148/102, 103

[56] References Cited

U.S. PATENT DOCUMENTS 4,837,114 6/1989 Hamada et al. ..... 427/127

OTHER PUBLICATIONS

F. A. Lowenheim, *Electroplating,* McGraw-Hill Book Co., New York, 1978, pp. 67-92, 211-225.

*Primary Examiner*—John F. Niebling
*Assistant Examiner*—William T. Leader
*Attorney, Agent, or Firm*—McAuley, Fisher, Nissen, Goldberg & Kiel

[57] ABSTRACT

Corrosion-resistant rare earth magnets and a method for their manufacture, said magnets containing at least one rare earth element in an amount of 5 to 40 weight %, Fe in an amount of 50 to 90 weight %, Co in an amount of 0 to 15 wt %, B in an amount of 0.2 to 8 weight %, and at least one additive selected from Ni, Nb, Al, Ti, Zr, Cr, V, Mn, Mo, Si, Sn, Ga, Cu, and Zn in an amount of 0 to 8 weight %. The method comprises the steps of: (i) pretreating the surfaces of the magnet after sintering it; (ii) activating the surfaces thereof; and (iii) coating the surfaces thereof with at least one layer of Ni-containing film by electroplating. The activating may be carried out by treating the surfaces with a soap or a surface active agent. The activated surfaces may be subjected to ultrasonic vibrations in water to remove foreign substances before electroplating.

8 Claims, 3 Drawing Sheets

METHOD FOR PRODUCING A CORROSION RESISTANT RARE EARTH-CONTAINING MAGNET

BACKGROUND OF THE INVENTION

1. Field of the Invention

The present invention relates to a method for producing rare earth-containing permanent magnets which are highly corrosion resistant, and in particular to a method for producing sintered rare earth-iron-boron-based permanent magnets the surfaces of which are coated uniformly with a corrosion resistant metal layer.

2. Description of the Prior Art

Owing to their excellent magnetic properties and inexpensiveness, rare earth permanent magnets are extensively used in the electric and electronic industrial fields. The ever progressing technology in these fields constantly demands further improvements in the performances of these magnets. Rare earth permanent magnets containing neodymium as a rare earth element are especially favored and are replacing the samarium-cobalt-based rare earth permanent magnets in the small-type magnetic circuits. This is because the magnetic properties of the neodymium-containing rare earth permanent magnets are far better than those of the conventional Sm-Co-based rare earth permanent magnets, neodymium is naturally more abundant than samarium, and the neodymium-containing rare earth magnets require much less expensive cobalt component as compared to the conventional Sm-Co-based rare earth permanent magnets. Also, the economy of the neodymium-containing rare earth magnets has motivated their use in the various applications where hard ferrite and alnico magnets or electromagnets are conventionally used. However, like all of the other rare earth elements, neodymium has an unfavorable tendency to easily oxidize in air, and especially in moist air. This oxidation not only gives rise to an oxide layer in the surfaces of the magnet, but also proceeds inwardly to cause intergranular corrosion, which develops along the grain boundary. This phenomenon is the most noticeable in the Nd magnets, because a very active Nd-rich phase exists in the grain boundary of the Nd magnets. The intergranular corrosion leads to a profound decrease in the magnetic properties, and if the corrosion progresses while the magnet is in use, the performance of apparatus using the magnet deteriorates, and the peripheral devices are contaminated.

Various surface treatment methods have been proposed to solve the oxidation problem of the rare earth magnets, and particularly, the neodymium-containing magnets. However, none of the proposed methods has been sufficient to put an end to the problem. For example, a method whereby the magnet surfaces are coated by spraying or electrocoating with a resin film results in rusting immediately beneath the resin film due to the hygroscopicity of the resin. Vapor plating methods, such as vacuum deposition, ion spattering, and ion plating, are costly and are not effective in coating the receded surfaces, such as the holes and grooves.

SUMMARY OF THE INVENTION

Accordingly, the inventors have solved these problems and discovered a group of permanent magnets which show minimal degradation in magnetic properties and appearance for a long period of time. The inventive magnets constitute a sintered rare earth permanent magnet of an alloy containing at least one rare earth element in an amount of 5 to 40 weight %, Fe in an amount of 50 to 90 weight %, Co in an amount of 0 to 15 wt %, B in an amount of 0.2 to 8 weight %, and at least one additive selected from Ni, Nb, Al, Ti, Zr, Cr, V, Mn, Mo, Si, Sn, Ga, Cu, and Zn in an amount of 0 to 8 weight %. The inventive magnets are produced by the steps of treating and coating the surfaces of said sintered magnet with a Ni film or a Ni-containing film. In particular the method comprises the steps of: preparing an ingot of said alloy; pulverizing the ingot into fine powder; magnetically orienting the powder in a mold; compacting the powder in the mold; sintering the compact; aging the compact at a high temperature; cutting a magnet piece from the sintered compact; and further comprises the steps for rendering the surfaces of the magnet piece corrosion resistant by pretreating the surfaces of the sintered magnet; activating the surfaces thereof; and coating the surfaces with a Ni-containing film by electroplating.

DESCRIPTION OF THE PREFERRED EMBODIMENTS

Figure 1:
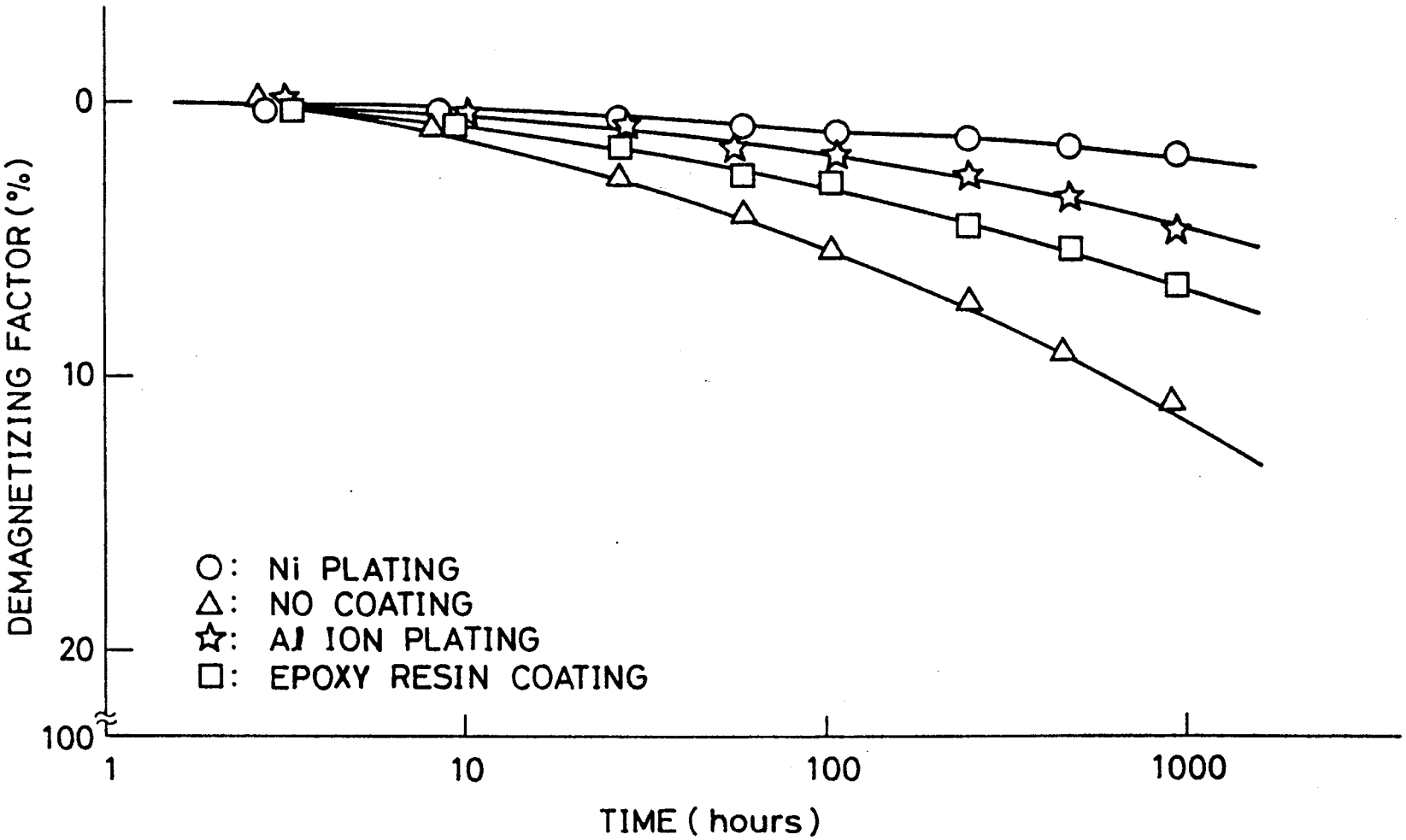
FIG. 1 shows the change of demagnetization with time of various magnetic samples subjected to a humidity test.

Rare earth elements in the sintered inventive magnets are Sc, Y, La, Ce, Pr, Nd, Pm, Sm, Eu, Gd, Tb, Dy, Ho, Er, Tm, Yb, and Lu including mixtures thereof. The overall content of the rare earth element(s) should fall in the range between 5 and 40 weight %. The sintered magnet should further contain from 50 to 90 weight % of Fe, 0 to 15 weight % of Co, 0.2 to 8 weight % of B, and 0 to 8 weight % of at least one additive selected from Ni, Nb, Al, Ti, Zr, Cr, V, Mn, Mo, Si, Sn, Ga, Cu, and Zn, and in addition to these, trace amounts of industrially unavoidable impurities, such as C, O, P, and S. Also, as a result of the Ni-plating, the magnet in its final form is clad with a nickel film or a film of a Ni-containing alloy.

The inventive magnets may be prepared by the following inventive method.

Pretreatment Step (i) descaling

Descaling is performed for the purpose of removing the oxide film from the surfaces of the rare earth magnet. It may be accomplished by polishing with a grindstone, a buff, or a barrel, or through sand blasting, honing, or brushing. After descaling, the surfaces of the magnet are free of rust, dirt, and other impurities.

(ii) solvent degreasing

Solvent degreasing is performed for the purpose of removing oil and fat from the surfaces of the rare earth magnet. The degreasing is effected by immersing the magnet in a solvent, such as trichloroethylene, perchloroethylene, trichloroethane, and fleon, or spraying such a solvent on the magnet surfaces. After the degreasing operation, the surfaces of the magnet are free of organic substances, such as oils for pressing, cutting lubricant, and rust preventive oil.

(iii) alkaline degreasing

Like solvent degreasing, the alkaline degreasing is performed for the purpose of removing oil and fat from the surfaces of the rare earth magnet. Generally speaking, solvent degreasing is a preliminary degreasing step and alkaline degreasing constitutes the main degreasing operation. The alkaline liquid used for degreasing is a water solution of at least one of the following substances which are contained in a total amount of from 5 g to 200 g per liter of the solution: sodium hydroxide, sodium carbonate, sodium orthosilicate, sodium metasilicate, trisodium phosphate, sodium cyanide, and a chelating agent. The alkaline liquid is warmed to room temperature or heated to a temperature not higher than 90° C., and then the magnet is immersed in it, whereby the degreasing is effected. It is possible to perform electrolytic cleaning, such as cathode electrolysis or anode electrolysis or PR electrolysis simultaneously as the alkaline degreasing is carried out.

(iv) acid cleaning

Acid cleaning is performed for the purpose of removing from the magnet surfaces traces of materials, such as the oxide film which failed to be removed during the previous cleaning operations, the alkaline film which was formed as a result of alkaline degreasing, and the oxide film which was formed as a result of the electrolytic cleaning. The liquid used for acid cleaning is a water solution of at least one of the following substances having an overall concentration of 1 to 40%, or preferably 18 to 40%: sulfuric acid, hydrofluoric acid, nitric acid, hydrochloric acid, permanganic acid, oxalic acid, acetic acid, formic acid, hydroxyacetic acid, and phosphoric acid. The cleaning liquid is heated to a temperature between 10° C. and 60° C., and then the rare earth magnet is immersed in it, whereby impurities, such as oxides, hydroxides, sulfides, and metal salts are removed from the magnet surfaces.

According to the invention, at least one of the four cleaning operations (i), (ii), (iii), (iv) described above is performed by way of the pretreatment step, and it is preferred that two or more operations are performed. The time for each cleaning operation can be suitably determined. Each cleaning operation must be followed by washing with water.

Activation Step

The activation step is carried out before plating for the purpose of increasing the surface energy of the rare earth magnet to provide enhanced adhesion between the plated film and the magnet surface. As a result of this activation treatment, since the protective plated film adheres to the surfaces of the rare earth magnet firmly and permanently, corrosive materials are kept from attacking the magnet surfaces and thereby the corrosion resistance of the magnet is improved. The liquid used for the activation treatment is a water solution of one or more of the solutes used in the liquid for acid cleaning, but the solute(s) is thinner in the activator liquid. That is to say, the liquid for the activation treatment is an aqueous solution of at least one of the following substances having an overall concentration of 1 to 20%, or preferably 1 to 15%: hydrochloric acid, sulfuric acid, hydrofluoric acid, nitric acid, permanganic acid, oxalic acid, acetic acid, hydroxyacetic acid, and phosphoric acid. If a greater activation effect is desired, a small amount of interfacial, i.e., surface active agent is added. A preferred interfacial active agent comprises at least one of the following substances: a soap, e.g., sodium lauryl sulfate, sodium myristate, sodium palmitate, or sodium stearate; a synthesized anionic interfacial active agent, e.g., a branched alkylbenzene sulfate, straight chain alkylbenzene sulfate, alkane sulfonate, or α-olefin sulfate; a cationic surface active agent, e.g., alkyldimethylbenzyl ammonium chloride; and a nonionic surface active agent, e.g., nonylphenolpolyoxyethylene ether. One or more of these substances should be added in an amount such that the overall concentration of the substance(s) in the interfacial active agent is 3% or less. There are cases where a sequestering agent is added so as to lengthen the useful life of the interfacial active agent. A preferred sequestering agent contains at least one of the following solutes to the extent that the overall content of the solutes becomes 5 weight % or less: an inorganic sequestering material, e.g., sodium pyrophosphate, sodium tripolyphosphate, sodium tetrapolyphosphate, or sodium hexametaphosphate; or an organic sequestering material, e.g., citric acid, gluconic acid, tartaric acid, diethylenetriaminopenta acetate, or hydroxyethylenediamintetraacetate.

An aqueous solution as prepared in the manner described above, containing an acid, an interfacial active agent, and a sequestering material in respective appropriate amounts, is heated to a temperature between 10° C. and 80° C., and the rare earth magnet is surface-activated by immersion in the solution.

After the activation treatment step, the magnet must be thoroughly rinsed with water. This rinsing is especially important to carry out before performing plating of the rare earth magnet. The rinsing removes the foreign materials and the treatment liquid which have attached themselves to the magnet during the previous step. If these undesirable materials remain on the magnet surfaces, the effect of the subsequent surface treatment will be reduced, and especially in the case of the plating step the plating film will tend to fail in acquiring sufficient adhesion to the magnet surface.

In order to improve the effect of water rinsing, it is effective to apply ultrasonic vibration to the water bath in which the magnet pieces are rinsed. Application of ultrasonic vibration is a common practice in cleaning substances such as the lenses of glasses. When ultrasonic cleaning is applied to a rare earth-containing magnet before electroplating it, the adhesion of the plating film to the magnet surfaces is greatly faciliated. It is known that some of the dusts sticking to the surfaces of the magnet are magnetically attracted thereto. When vibrated by ultrasonic wave, these dusts are physically removed from the surfaces. At this moment the dusts are under weaker influence of the magnetic attraction, and they flow in the water.

Nickel Electroplating Step

The plating bath to be used for nickel electroplating in the present invention is an aqueous solution prepared in the following manner.

At least one of the following nickel salts is added to water in an overall amount of 50 to 500 g per liter: nickel ammonium sulfate, nickel sulfate, nickel chloride, nickel sulfamide, and nickel tetrafluoroborate. Also, ammonium chloride and boric acid are added each in an amount of 10 g to 50 g per liter. Further, when necessary, small quantities of a pit preventive agent, e.g., sodium lauryl sulfate, or hydrogen peroxide; a primary brightening agent, e.g., benzene, naphthalene, or saccharin; and a secondary brightening agent, e.g., butynediol, coumalin, or thiourea are selectively added.

An appropriate range for the pH value of the plating bath is 2 to 7, and the temperature thereof should be maintained between 20° C. and 70° C. The cathode current density should be from 0.1 to 10.0 A/dm$^2$. The plating film obtained from this plating bath mainly comprises nickel, and may contain iron, copper, manganese, zinc, cobalt, carbon, oxygen, and the like as impurities. By adding a salt of a metal in addition to the nickel salt(s) in the plating bath, it is possible to obtain a plating film comprising an alloy of nickel and the metal. This is possible when the metal to be coupled with nickel is Sn, Cu, Zn, Co, Fe, Cr, P, B, and the like.

For further improvements in the corrosion resistance, a plurality of plating films of nickel alloy having slightly different compositions can be laminated on the magnet surfaces. Although this complicates the electroplating step, for as many plating baths as the number of different compositions are required, the corrosion resistance is greatly improved as the contact corrosion mechanism between the adjacent plating layers or films gives rise to a sacrificial anode effect.

The residual internal stress in the nickel plating layer(s) formed on the rare earth magnet significantly affects the adhesion between the plating layer(s) and the magnet surfaces. Whether measured as tensile stress or compressive stress, the greater the residual internal stress is in magnitude, the greater is the weakening of the adhesion. Therefore, it is desired to reduce the absolute value of the internal stress.

In corrosion tests, it is often observed that when the defect of the plating film is initiated by the corrosion of the magnet surface underneath the plating film, the defect leads to weakened adhesion between the plating film and the magnet surfaces. In such circumstance, if the plating film(s) contains a comparatively large amount of residual stress, the weakening of the adhesion increases and, as a result, development of even slight corrosion gives rise to plating defects, such as blistering and exfoliation.

In order to alleviate the residual stress in the plating film(s), the concentration of the chloride, the value of pH, or other factors are adjusted. It has been also found effective to introduce an appropriate amount of secondary brightening agent. Other effective stress relievers include various organic compounds, such as, aldehydes, ketones, sulfonated allyl aldehydes, and acetylene alcohols. The internal stress of Ni plating film(s) on the rare earth magnet surface is controlled to a magnitude of 1400 kg/cm$^2$ or smaller by adjusting various plating conditions and dosages of additives to the plating bath. The desired thickness of the Ni plating film(s) depends on the degree of corrosion resistance called for. Conventionally, the thickness is from 1 μm to 100 μm. When the plating is thinner than 1 μm, the corrosion resistance will be too low, and when thicker than 100 μm, the time and cost required will render the operation uneconomical. The range of the plating thickness which is economical as well as sufficiently corrosion-resistive is roughly from 5 μm to 20 μm.

The method of plating can be either the plating rack or the barrel plating method, and is determined based on the size, shape, quantity, etc., of the magnet product.

The plating time is determined based on the desired plating thickness and the adopted current density. In the case of the barrel plating method, the current density is usually set at a relatively low value so as to minimize the scattering in the plating thickness. Therefore, the time required to obtain a certain thickness of plating is longer with the barrel plating method than with the rack method.

A plating film of nickel or a nickel alloy laid on a neodymium magnet has a Vickers hardness of 100 to 300 and a tensile strength of 50 to 139 kpsi. Nickel plating is highly corrosion resistant. However, when it is subjected to a corrosion test it happens occasionally that the plating film acquires a brown or light black color. In order to prevent the color changes, a chromate treatment is conducted in which the plated magnet is steeped in an aqueous solution of chromic anhydride. By means of this chromate treatment, the gloss of the plated surfaces of the magnet is preserved. Also, to maintain the fine appearance of neodymium magnet, a certain amount of electric current is conducted through the magnet during the chromate treatment to deposit a chromium film having a thickness of 1 μm or smaller on the magnet surfaces. The chromium layer has a tendency to form a protective passivation film.

The following examples illustrate the invention.

EXAMPLE 1

An ingot of an alloy composed of 32.0 wt. % of Nd, 2.0 wt. % of Tb, 1.1 wt. % of B, 58.4 wt. % of Fe, 5.0 wt. % of Co, 1.0 wt. % of Al, and 0.5 wt. % of Ga was made by means of high-frequency melting in an argon gas atmosphere. This ingot was pulverized with a jaw-crusher, and then finely milled by means of a nitrogen gas jet stream into particles of an average size of 3.5 μm. This fine powder was charged in a metal mold and a magnetic field of 10,000 Oe was created to magnetically orient the powder while a physical pressure of 1.0 t/cm$^2$ was imposed on the powder. The compact was sintered in a vacuum at a temperature of 1090° C. for two hours. It was then aged at a temperature of 550° C. for one hour. A square test piece measuring 30 mm×30 mm×3 mm (thick) was cut from the permanent magnet thus obtained. For the sake of comparison, three more square pieces were cut from the same magnet. The axis of easy magnetization was established in the direction of thickness. This test piece was treated in the following manner.

Pretreatment Step (i) descaling centrifugal barrel polishing: 10 minutes (ii) alkaline degreasing An alkaline degreasing solution of the following solutes was prepared and warmed to maintain a temperature of 30° C., and the magnet was steeped in it for 30 minutes.

sodium hydroxide: 10 g/lit
sodium metasilicate: 3 g/lit
trisodium phosphate: 10 g/lit
sodium bicarbonate: 8 g/lit
interfacial active agent: 2 g/lit

Activation Step

An activator solution of the following ingredients was prepared and the magnet was steeped in it for one minute.

acetic acid: 2% (v/v)
hydrochloric acid: 2% (v/v)
sulfuric acid: 2% (v/v)
sodium lauryl sulfate: 1 g/lit The magnet was subjected to ultrasonic cleaning for 30 seconds in water.

Nickel Electroplating Step

The nickel electroplating was conducted under the following conditions.

The plating bath contained:
nickel sulfate: 100 g/lit
ammonium chloride: 30 g/lit
boric acid: 25 g/lit
brightening agent: a little
pH of the plating bath: 5.0 to 5.5
temperature of the plating bath: 30° C.
cathode current density: 0.1–2.0 A/dm$^2$ The chromate treatment was performed after the electroplating, and the test piece was subjected to a corrosion test in which the temperature was maintained at 80° C., and the humidity at 90%. The demagnetizing factor was measured after lapses of certain lengths of time. The three comparative magnet pieces, which had respectively received the following treatments, were also put to the corrosion test and their demagnetizing factors were similarly measured.

Δ: no coating
□: phosphating with zinc phosphate followed by spray coating with an epoxy resin
☆: aluminum ion plating The results with increasing time are shown in FIG. 1. Compared with the comparative sample pieces, the inventive magnet exhibited less deterioration in the magnetic property with time. Hence the improved corrosion resistance obtained by means of the inventive method was also confirmed.

EXAMPLE 2

An ingot of an alloy composed of 32.9 wt. % of Nd, 1.1 wt. % of B, and 66.0 wt. % of Fe was made by means of high-frequency melting in an argon gas atmosphere. This ingot was pulverized with the jawcrusher, and finely milled by means of a nitrogen gas jet stream into particles of an average size of 3.5 μm. This powder was charged in a metal mold and a magnetic field of 10,000 Oe was created to orient the powder while a physical pressure of 0.8 t/cm$^2$ was imposed on the powder. The compact was sintered in a vacuum at a temperature of 1100° C. for two hours. It was then aged at a temperature of 550° C. for one hour. A washer-shaped test piece measuring 10 mm (i.d.)×25 mm (o.d.)×1.5 mm (thick) was cut from the permanent magnet thus obtained. For the sake of comparison, three more similar pieces were cut from the same magnet. The axis of easy magnetization was established in the direction of thickness. This test piece was treated in the following manner.

PRETREATMENT STEP (i) descaling
barrel polishing: 12 hours
(ii) solvent degreasing
The magnet was steeped in perchloroethylene and cleaned with steam.
(iii) alkaline degreasing
An alkaline degreasing solution of the following solutes was prepared and warmed to maintain a temperature of 60° C., and the magnet was steeped in it for 30 minutes.
sodium hydroxide: 37.5 g/lit
sodium carbonate: 11.5 g/lit
trisodium phosphate: 3 g/lit
sodium orthosilicate: 5 g/lit
(iv) acid cleaning
An acid cleaning solution of the following solutes was prepared, and the magnet was steeped in it for 3 minutes.
nitric acid: 10% (v/v)
sulfuric acid: 5% (v/v)

Activation Step

An activator solution of the following solutes was prepared and the magnet was steeped in it for thirty seconds.
hydrochloric acid: 10% (v/v)
hydroxy acetic acid: 2% (v/v)
The magnet was subjected to ultrasonic cleaning for 30 seconds in water.

Nickel Electroplating Step

The nickel electroplating was conducted under the following conditions.

The plating bath contained:
nickel sulfate: 280 g/lit
nickel chloride: 48 g/lit
boric acid: 30 g/lit
saccharin: 1.5 g/lit
pH of the plating bath: 4.0 to 5.5
temperature of the plating bath: 40°–60° C.
cathode current density: 2–6 A/d m$^2$ The chromate treatment was performed after the electroplating, and the test piece was subjected to an autoclave test in which the test piece was exposed to a saturated aqueous vapor of 2 atm and 120° C. The demagnetizing factor was measured after lapses of certain length of time from the test. The three comparative magnet pieces, which had respectively received the following treatments, were also put to the autoclave test and their demagnetizing factors were similarly measured.

Figure 2:
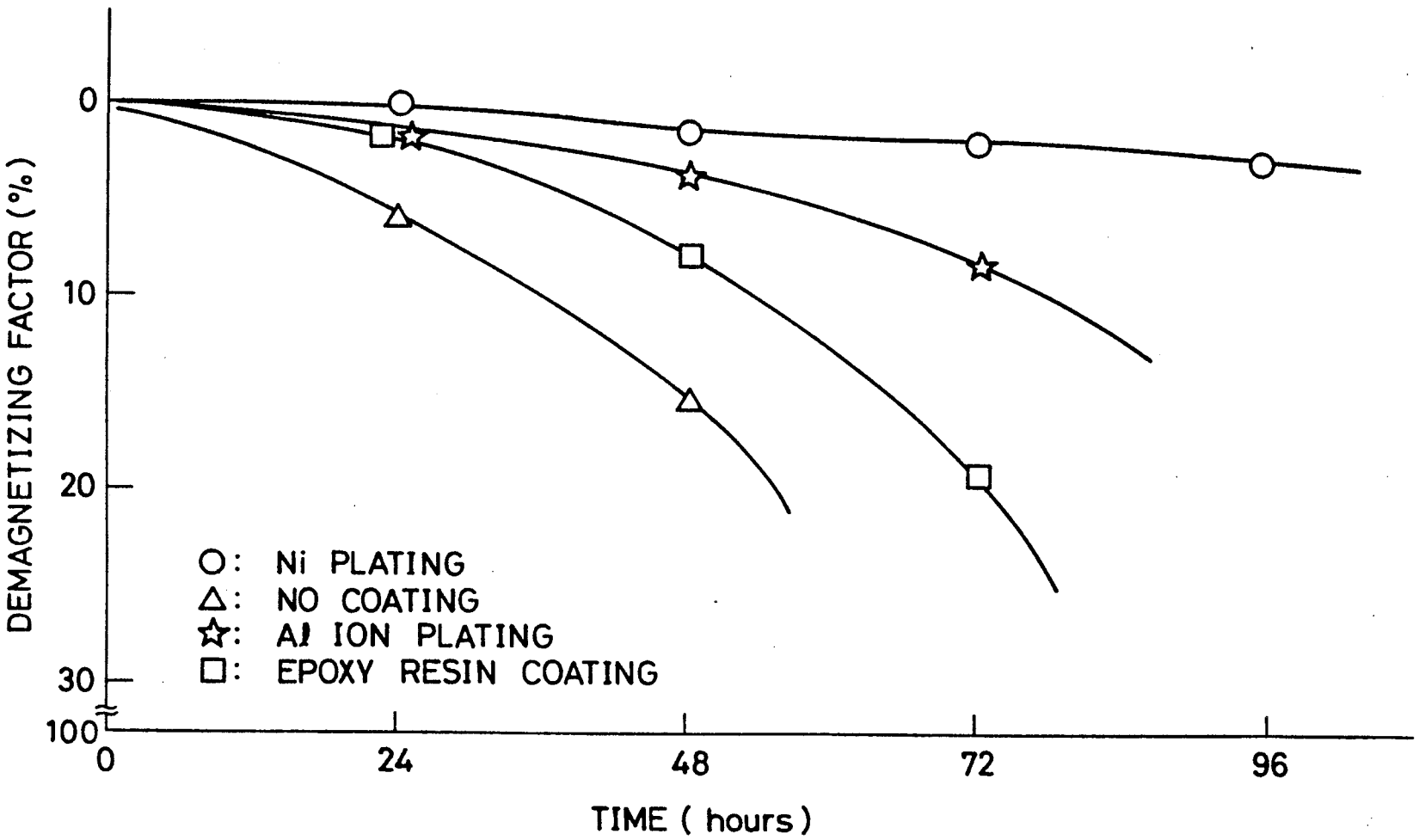
FIG. 2 shows the change of demagnetization with time of various magnetic samples subjected to an autoclave corrosion test.

Δ: no coating
□: phosphating with zinc phosphate followed by spray coating with an epoxy resin
☆: aluminum ion plating The result is plotted with respect to the passing of time in FIG. 2. The three comparative sample pieces underwent significant deterioration in magnetic property within seventy-two hours of the autoclave test, and rust and blisters were observed on their surfaces. On the other hand, with the inventive nickel-plated magnet the initial magnetic property was maintained over 96 hours. No abnormality was observed in the appearance of the nickel-plated magnet. Hence the corrosion resistance obtained by means of the method of the invention was confirmed to be effective.

EXAMPLE 3

An ingot of an alloy composed of 28.0 wt. % of Nd, 3.0 wt. % of Pr, 2.0 wt. % of Dy, 1.1 wt. % of B, 61.9 wt. % of Fe, 3.0 wt. % of Co, 0.5 wt. % of Al, and 0.5 wt. % of Nb was made by means of high-frequency melting in an argon gas atmosphere. This ingot was pulverized with the jawcrusher, and finely milled by means of a nitrogen gas jet stream into particles of an average size of 2.8 μm. This powder was charged in a metal mold and a magnetic field of 10,000 Oe was created to orient the powder while a physical pressure of 1.2 t/cm$^2$ was imposed on the powder. The compact was sintered in a vacuum at a temperature of 1090° C. for two hours. It was then aged at a temperature of 550° C. for one hour. A washer-shaped test piece measuring 10 mm (i.d.)×25 mm (o.d.)×1.5 mm (thick) was cut from the permanent magnet thus obtained. For the sake of comparison, three more similar pieces were cut from the same magnet. The axis of easy magnetization was established in the direction of thickness. This test piece was then treated in the following manner.

Pretreatment Step (i) descaling centrifugal barrel polishing: 0.5 hour (ii) solvent degreasing The magnet was steeped in trichloroethylene and cleaned with ultrasonic vibration and then with steam.

(iii) alkaline degreasing

An alkaline degreasing solution of the following solutes was prepared and warmed to maintain a temperature of 60° C., and the magnet was steeped in it for 60 minutes.

sodium hydroxide: 40 g/lit sodium carbonate: 30 g/lit (iv) acid cleaning

An acid cleaning solution of the following solutes was prepared, and the magnet was steeped in it for 5 minutes.

hydrochloric acid: 5% (v/v)

nitric acid: 5% (v/v)

potassium permanganate: 10 g/lit

Activation Step

An activator solution of the following solutes was prepared and the magnet was steeped in it for sixty seconds.

acetic acid: 5% (v/v)

hydrochloric acid: 5% (v/v)

alkylbenzene sulfate: 0.5% (v/v)

tartaric acid: 2% (v/v)

The magnet was subjected to ultrasonic cleaning for 30 seconds in water.

Nickel Electroplating Step

The nickel electroplating was conducted under the following conditions.

The plating bath contained:

nickel sulfamide: 350 g/lit nickel chloride: 20 g/lit boric acid: 30 g/lit pH of the plating bath: 3–5 temperature of the plating bath: 40°–50° C.

cathode current density: 2–6 A/dm$^2$ pit preventive agent: a little

The test piece was then subjected to a corrosion test in which the test piece was exposed to an atmosphere of a humidity of 90% and a temperature of 80° C. The demagnetizing factor was measured after lapses of certain lengths of time. The three comparative magnet pieces, which had respectively received the following treatments, were also put to the autoclave test and their demagnetizing factors were measured similarly.

Δ: no coating

Figure 3:
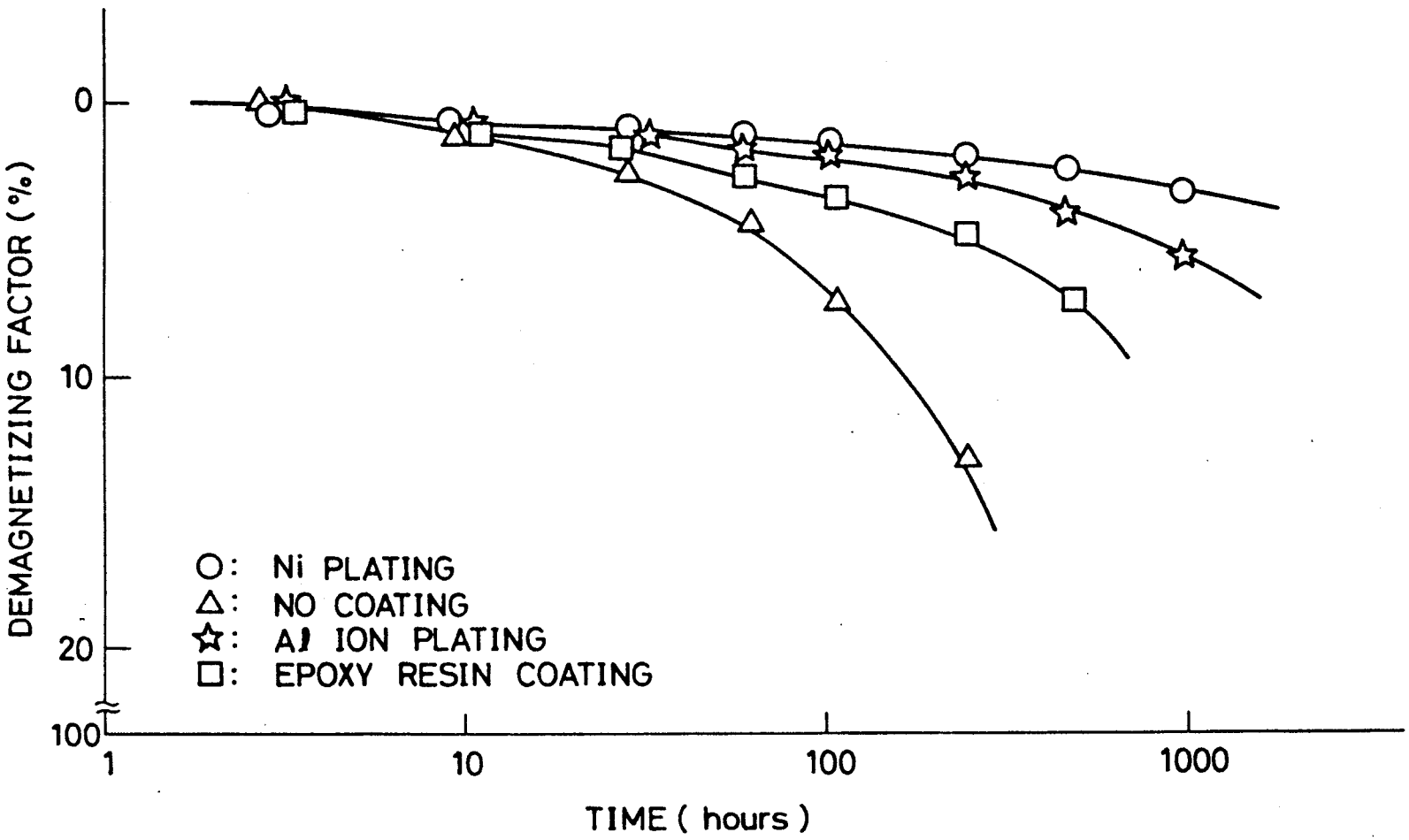
FIG. 3 is a graph similar to that of FIG. 1.

□: phosphating with zinc phosphate followed by spray coating with an epoxy resin ☆: aluminum ion plating The result is plotted with respect to lapses of time in FIG. 3. Compared with the three comparative sample pieces, the inventive nickel-plated magnet exhibited less deterioration in magnetic property, which indicates its higher corrosion resistance.

The foregoing three examples, wherein the inventive method of manufacturing rare earth permanent magnet are described and compared with the conventional methods, indicate that the magnets obtained through the inventive method have improved corrosion resistance and thus their magnetically effective lives are substantially extended.

EXAMPLE 4

The comparative tests involving this example were conducted so as to confirm the cleaning efficiency of the ultrasonic vibration applied to the magnet pieces in water.

From the mass of the permanent magnet obtained in Example 2, twenty magnet pieces measuring 50 mm×30 mm×10 mm were cut. The axis of easy magnetization was established in the direction of thickness. Ten of these test pieces were treated in the same manner as in the case of Example 2, and the other ten pieces were treated exactly in the same manner as in the case of Example 2 except that in the activation step the ultrasonic cleaning was not conducted. The latter 10 pieces constitute the group of magnet pieces of Example 4.

Further, 10 pieces each of magnets measuring 50 mm×30 mm×10 mm were cut from the masses of the permanent magnet obtained in Examples 1 and 3. Similarly the axis of easy magnetization was established in the direction of thickness in all pieces. They were then treated in exactly the same manner as in the case of Example 2.

Now, four groups of Ni-plated test pieces, each consisting of ten magnet pieces, were prepared. Each piece was subjected to the following test:

A rectangular tin sheet of a thickness of 0.4 mm and a width of 10 mm was bent at 10 mm from an end by an angle of 90° to form a raised square portion measuring 10 mm×10 mm. An adhesive material was spread over the external face of this square portion and the tin sheet was attached to a surface of the test piece by means of the adhesive material.

After waiting for a sufficient time to allow the adhesive to cement the two metallic bodies together, the adhesion test was conducted wherein the magnet test piece was fixed and the tin sheet was pulled up by means of a load test apparatus. The force required to disconnect the tin sheet together with the Ni-plating layer from the magnet surface was measured. The result was as shown in the table below.

| | Adhesion, kg/cm$^2$ (Force required to peel Ni-plate layer) | | |
|---|---|---|---|
| | minimum | average | maximum |
| Example 1 | 75 | 98 | 124 |
| Example 2 | 73 | 106 | 126 |
| Example 3 | 67 | 88 | 120 |
| Example 4 | 25 | 42 | 73 |

It was confirmed from the result that the ultrasonic vibration applied to the magnet surfaces in the activation step of the invention improves the adhision of the Ni-plating layer.

What is claimed is:

1. In a method for producing a corrosion resistant rare earth containing magnet wherein a magnet unit having surfaces is obtained from a rare earth containing alloy through the following steps:

(a) preparing an ingot of an alloy containing at least 5 to 40 weight percent of at least one rare earth element, 50 to 90 weight percent of Fe, 0 to 15 weight percent of Co, 0.2 to 8 weight percent of B, and 0 to 8 weight percent of at least one element selected from the group consisting of Ni, Nb, Al, Ti, Zr, Cr, V, Mn, Mo, Si, Sn, Ga, Cu, and Zn;

(b) pulverizing the ingot into a fine powder;

(c) magnetically orienting the powder in a mold;

(d) compacting the powder in the mold to produce a compact;

(e) sintering the compact;

(f) aging the compact at elevated temperatures; and (g) dividing the compact in units having surfaces; the improvement comprising the following steps to which each magnet unit is subjected after step (g):

(h) cleaning the surfaces of the magnet unit;

(i) activating the cleaned magnet surfaces by treating the magnet surfaces with a substance selected from the group consisting of a soap, a synthesized anionic surface active agent, a cationic surface active agent, a nonionic surface active agent and combinations thereof;

(j) subjecting the activated magnet surfaces to ultrasonic vibrations in water to remove foreign material therefrom; and (k) coating the magnet surfaces with at least one layer of a Ni-containing film by electroplating.

2. The improved method of claim 1 wherein said Ni-containing film is a Ni film.

3. The improved method of claim 1 wherein said cleaning step is selected from the group consisting of descaling, solvent degreasing, alkaline degreasing, acid cleaning, ultrasonic cleaning and combinations thereof.

4. The improved method of claim 1 wherein said coating step is performed in a plating bath containing 10 g to 50 g each of ammonium chloride and boric acid per liter of water and a salt in an overall amount of 50 to 500 g per liter of water selected from the group consisting of nickel ammonium sulfate, nickel sulfate, nickel chloride, nickel sulfamide, nickel tetrafluoroborate and combinations thereof.

5. The improved method of claim 4 wherein said plating bath has a pH value of 2 to 7 and a temperature of 20° to 70° C.

6. The improved method of claim 4 wherein a cathode current density of 0.1 to 10.0 $A/dm^2$ is used in the electroplating.

7. The improved method of claim 1 wherein said magnet surfaces are coated with more than one Ni-containing film, each of a different Ni alloy.

8. The improved method of claim 1 wherein at least one layer of Ni-containing film has a thickness of 5 $\mu m$ to 20 $\mu m$.

* * * * *